US009322413B2

(12) United States Patent
Lin et al.

(10) Patent No.: US 9,322,413 B2
(45) Date of Patent: Apr. 26, 2016

(54) CENTRIFUGAL FAN

(75) Inventors: Hsin-Chen Lin, Taoyuan Hsien (TW); Hsiang-Jung Huang, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 1028 days.

(21) Appl. No.: 13/283,615

(22) Filed: Oct. 28, 2011

(65) Prior Publication Data

US 2012/0148394 A1 Jun. 14, 2012

(30) Foreign Application Priority Data

Dec. 14, 2010 (TW) ..... 099143620 A

(51) Int. Cl.
*F04D 29/42* (2006.01)
*F04D 25/08* (2006.01)

(52) U.S. Cl.
CPC ..... *F04D 29/4213* (2013.01); *F04D 25/08* (2013.01); *F04D 29/4226* (2013.01)

(58) Field of Classification Search
CPC ..... F04D 17/16; F04D 25/08; F04D 29/4213; F04D 29/422; F04D 29/4226; F04D 29/424
USPC ..... 415/182.1, 203, 204, 206, 224, 224.5
See application file for complete search history.

(56) References Cited

U.S. PATENT DOCUMENTS 6,964,556 B2 * 11/2005 Chiu et al. ..... 415/205
7,455,504 B2 * 11/2008 Hill et al. ..... 416/179
7,497,659 B2 * 3/2009 Hsu et al. ..... 415/183
7,780,404 B2 * 8/2010 Horng et al. ..... 415/191
8,152,881 B2 * 4/2012 Chen et al. ..... 55/385.6
8,206,099 B2 * 6/2012 Tsai et al. ..... 415/206
8,662,832 B2 * 3/2014 Tsai et al. ..... 415/148
2005/0058543 A1 3/2005 Takeshita et al.
2008/0152486 A1 * 6/2008 Horng et al. ..... 415/203
2010/0092282 A1 * 4/2010 Hwang et al. ..... 415/206
2010/0232948 A1 * 9/2010 Horng ..... 415/182.1
2012/0121407 A1 * 5/2012 Yamashita ..... 415/213.1
2012/0148393 A1 * 6/2012 Lin et al. ..... 415/203
2012/0148394 A1 * 6/2012 Lin et al. ..... 415/203
2012/0156022 A1 * 6/2012 Otsuki et al. ..... 415/203
2013/0115066 A1 * 5/2013 Lin et al. ..... 415/182.1
2014/0030075 A1 * 1/2014 Chen ..... 415/182.1
2014/0133974 A1 * 5/2014 Yang et al. ..... 415/206
2014/0314558 A1 * 10/2014 Tsai et al. ..... 415/206

FOREIGN PATENT DOCUMENTS

TW 200928110 A 7/2009

* cited by examiner

*Primary Examiner* — Dwayne J White
*Assistant Examiner* — Christopher R Legendre
(74) *Attorney, Agent, or Firm* — CKC & Partners Co., Ltd.

(57) ABSTRACT

Disclosed herein is a centrifugal fan. A driving device is connected to an impeller and drives the impeller to rotate within a case. The flowing channel includes a pressure-enhanced section and an output section. The case includes an air input section, an axial inlet section and a radial air outlet. The bottom base has a center and allows the driving device to be secured thereon. Multiple ribs are interconnected between the bottom base and the case to define air inlets among the ribs, the bottom base and the case. The air inlet within the output section has an outmost edge, which is farther from the center than an outmost edge of the air inlet within the pressure-enhanced section, or the air inlet within the output section has an area, which is larger than that of the air inlet within the pressure-enhanced section.

8 Claims, 7 Drawing Sheets

CENTRIFUGAL FAN

RELATED APPLICATIONS

This application claims priority to Taiwan Application Serial Number 099143620, filed Dec. 14, 2010, which is herein incorporated by reference.

BACKGROUND

1. Field of Invention

The present invention relates to a fan. More particularly, the present invention relates to a centrifugal fan.

2. Description of Related Art

Conventional fans are commonly divided into two types: axial fans and centrifugal fans. The axial fans intakes air along an axial direction of the impeller and outputs air along the axial direction of the impeller, thereby being referred as "axial fans". The centrifugal fans intakes air along an axial direction of the impeller and outputs air along a radial direction of the impeller.

Referring to FIG. 1, it illustrates a cross-sectional view of a conventional impeller of the centrifugal fan. The centrifugal fan 100 includes a case 102 housing an impeller 104. The case 102 has air inlets (102*a*, 102*b*) located at two opposite sides of the impeller 104 and along an axial direction thereof. When the impeller 104 rotates, airflows are introduced into the case 102 through two air inlets (102*a*, 102*b*) and guided along a radial direction of the impeller 104 so as to become pressure-enhanced airflows 105. When the pressure-enhanced airflows 105 accumulate up to a threshold, part of the airflows may leak through the air inlet 102*b* along a direction 106, thereby decreasing an output airflow pressure of the centrifugal fan 100. Besides, noises are usually incurred due to the lost of pressure-enhanced airflow 10 through the air inlets.

For the crowded-art like the fan design industry, any improvements in performance, e.g. increasing an airflow pressure or reducing noises, need to be constantly perused. There is no exception for the forgoing problems.

SUMMARY

It is therefore an objective of the present invention to provide an improved centrifugal fan to deal with "the loss of pressure-enhanced airflow through the air inlets" as discussed.

In accordance with the foregoing and other objectives of the present invention, a centrifugal fan includes an impeller, a driving device and a case. The driving device is connected to the impeller and drives the impeller to rotate. The case houses the impeller and driving device so as to form a flowing channel therein. The flowing channel includes a pressure-enhanced section and an output section. The case includes an axial inlet section and at least a radial air outlet. The axial inlet section includes a bottom base and a plurality of ribs. The bottom base has a center and allows the driving device to be secured thereon. The plurality of ribs are interconnected between the bottom base and the case to define a plurality of air inlets among the ribs, the bottom base and the case. The air inlet within the output section has an outmost edge, which is farther from the center than an outmost edge of the air inlet within the pressure-enhanced section.

According to an embodiment disclosed herein, an arc sidewall of the flowing channel has a tongue portion close to the air radial air outlet.

According to another embodiment disclosed herein, a first boundary line between the output section and the pressure-enhanced section is a line interconnected between the tongue portion and the center.

According to another embodiment disclosed herein, a second boundary line between the output section and the pressure-enhanced section is a line interconnected between a terminal end of the arc sidewall and the center.

In accordance with the foregoing and other objectives of the present invention, a centrifugal fan includes an impeller, a driving device and a case. The driving device is connected to the impeller and drives the impeller to rotate. The case houses the impeller and driving device so as to form a flowing channel therein. The flowing channel includes a pressure-enhanced section and an output section. The case includes an axial inlet section and at least a radial air outlet. The axial inlet section includes a bottom base and a plurality of ribs. The bottom base has a center and allows the driving device to be secured thereon. The plurality of ribs are interconnected between the bottom base and the case to define a plurality of air inlets among the ribs, the bottom base and the case. The air inlet within the output section has an area, which is larger than that of the air inlet within the pressure-enhanced section.

According to an embodiment disclosed herein, an arc sidewall of the flowing channel has a tongue portion close to the air radial air outlet.

According to another embodiment disclosed herein, a boundary line between the output section and the pressure-enhanced section is a line interconnected between the tongue portion and the center.

According to another embodiment disclosed herein, the pressure-enhanced section is equally divided into a first pressure-enhanced section and a second pressure-enhanced section, wherein the first pressure-enhanced section is closer to the tongue portion than the second pressure-enhanced section is.

According to another embodiment disclosed herein, the air inlet within the output section has an area, which is 2.2 times bigger than an area of the air inlet within the first pressure-enhanced section.

According to another embodiment disclosed herein, the air inlet within the second pressure-enhanced section has an area, which is smaller than a 9/10 area of the air inlet within the first pressure-enhanced section.

Thus, the centrifugal fan with the improved axial inlet section design can be enhanced in reducing air-leaking though the air inlets and air-leaking noises.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
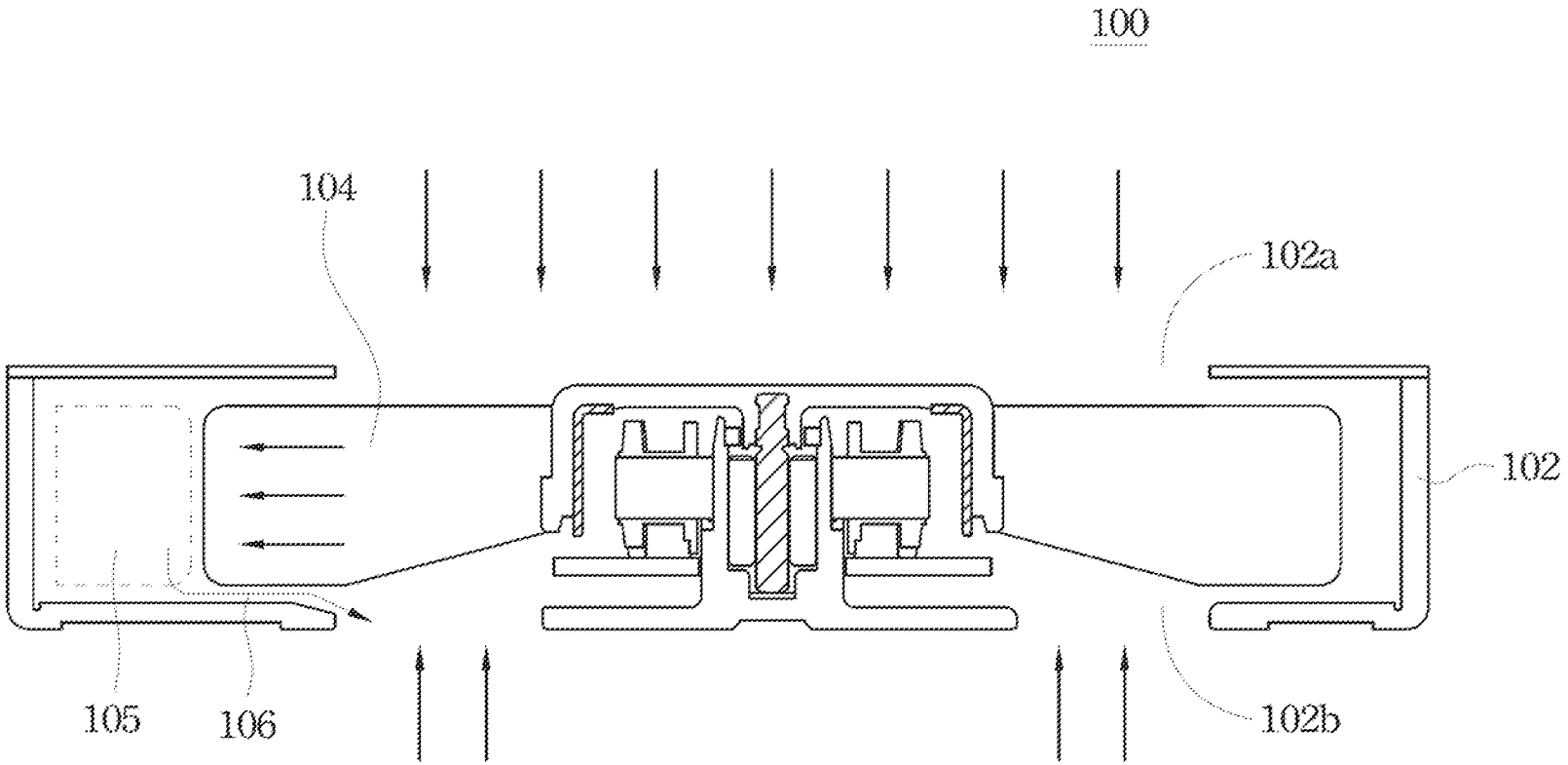
Fig. 1 (PRIOR ART)
FIG. 1 illustrates a cross-sectional view of a conventional centrifugal fan.

Reference will now be made in detail to the present preferred embodiments of the invention, examples of which are illustrated in the accompanying drawings. Wherever possible, the same reference numbers are used in the drawings and the description to refer to the same or like parts.

Figure 2:
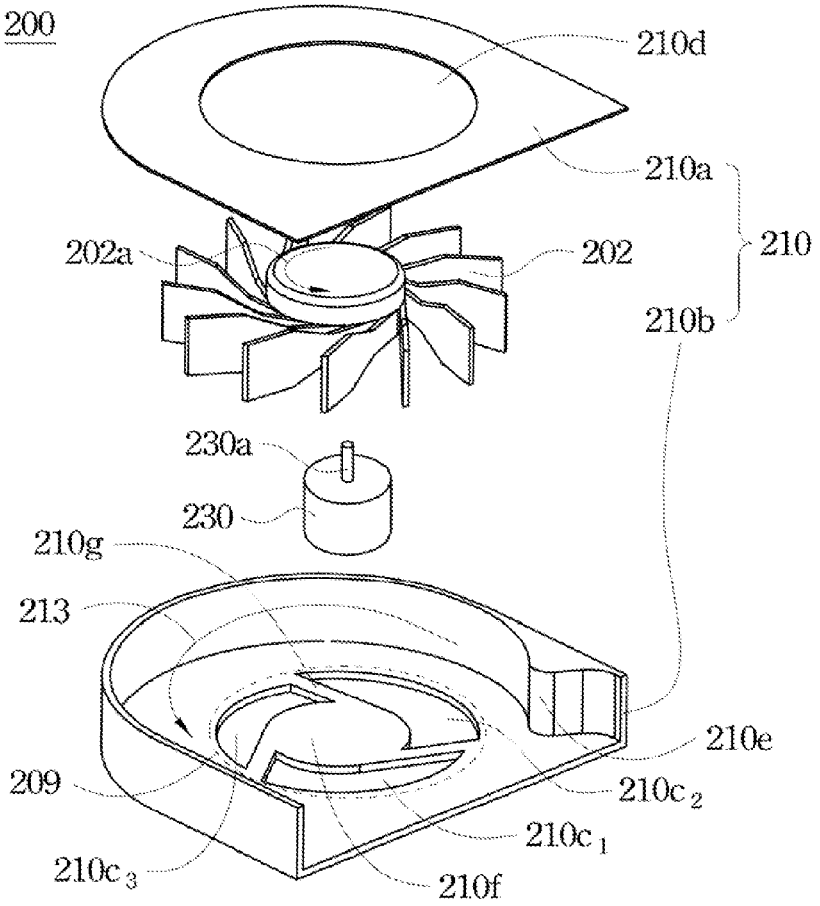
FIG. 2 illustrates an exploded view of a centrifugal fan according to one preferred embodiment of this invention.
Figure 3:
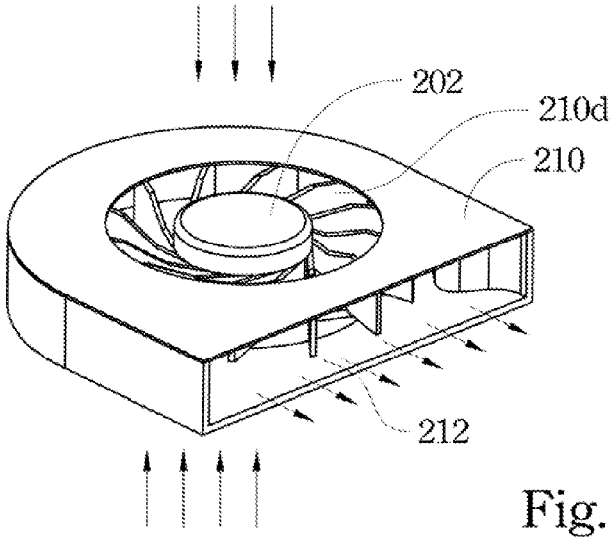
FIG. 3 illustrates an assembled status of the centrifugal fan as illustrated in FIG. 2.

Referring to both FIGS. 2 and 3, FIG. 2 illustrates an exploded view of a centrifugal fan according to one preferred embodiment of this invention, and FIG. 3 an assembled status of the centrifugal fan as illustrated in FIG. 2. A centrifugal fan 200 includes an impeller 202, a driving device 230 and a case 210. The case 210 houses the impeller 202 and the driving device 230 so as to define a flowing channel 213 therein. The case 210 includes an upper case 210*a* and a lower case 210*b*. The upper case 210*a* has an air inlet 210*d*. The lower case 210*b* has an axial inlet section 209, which includes a bottom base 210*f* and three ribs 210*g*. The air inlet 210*d* and the axial inlet section 209 are located at two opposite sides of the impeller 202 and along an axial direction of the impeller 202. A driving device 230 (such as a motor) is secured to the bottom base 210*f*. Three ribs 210*g* are interconnected between the bottom base 210*f* and the lower case 210*b*, thereby defining three air inlets (210$c_1$, 210$c_2$, 210$c_3$) among three ribs 210*g*, the bottom base 210*f* and the lower case 210*b*. A rotation shaft 230*a* of the driving device 230 is connected to the impeller 202 and drive the impeller 202 to rotate. When the impeller 202 rotates along a direction 202*a*, airflows are introduced into case 210 through air inlets (210*d*, 210$c_1$, 210$c_2$, 210$c_3$), guided along flowing channel 213 (e.g. the arrow direction), and then flowed out of the case 210 through the radial air outlet 212.

In this embodiment, the air inlets (210$c_1$, 210$c_2$, 210$c_3$) are designed as different sizes to control a width of the flowing channel within different sections such that high-pressured airflows within the flowing channel would not easily leak though the air inlets and air-leaking noises are thus reduced. Air inlets are designed in different ways as described in the following embodiments.

Figure 4:
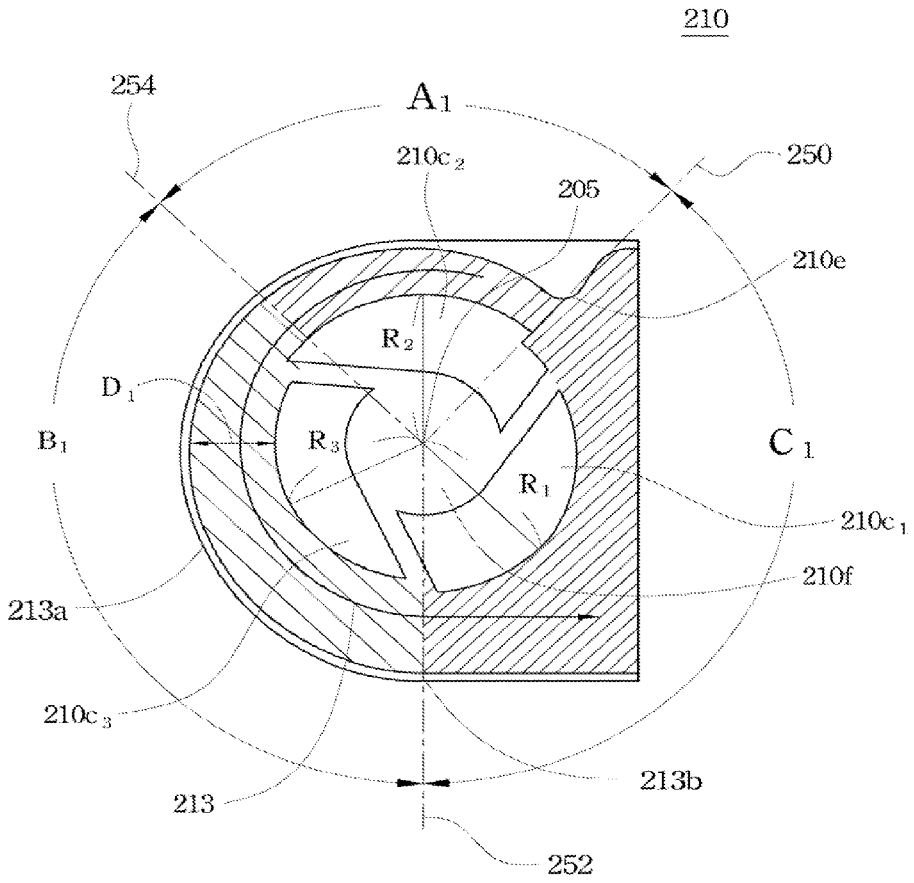
FIG. 4 illustrates a top view of a lower case of the centrifugal fan as illustrated in FIG. 2.

Referring to FIG. 4, which illustrates a top view of a lower case of the centrifugal fan as illustrated in FIG. 2. The flowing channel 213 of the lower case 210*b* are divided into a pressure-enhanced section ($A_1$+$B_1$) and an output section $C_1$. The airflows are gradually increased within the pressure-enhanced section ($A_1$+$B_1$) and then output through the output section $C_1$. Basically, an area of the flowing channel 213, which is close to the air outlet, is referred as the "output section". The pressure-enhanced section of the flowing channel 213 starts from a tongue portion 210*e* and ends at the output section $C_1$. The pressure-enhanced section can be further divided into a first pressure-enhanced section $A_1$ (with a lower pressure enhanced) and second pressure-enhanced section $B_1$ (with a high pressure enhanced), but a boundary line 254 therebetween is hard to draw. Generally, the first pressure-enhanced section $A_1$ is a region of 30-90 degrees starting from the tongue portion 210*e*. In this embodiment, a boundary line 250 between the first pressure-enhanced section $A_1$ and the output section $C_1$ is a line interconnected between the tongue portion 210*e* and a center 205 of the bottom base 210*f*. A boundary line 252 between the second pressure-enhanced section $B_1$ and the output section $C_1$ is a line interconnected between the center 205 and a terminal end 213*b* of the arc sidewall 213*a* of the flowing channel 213. The flowing channel within the pressure-enhanced section has a wider width $D_1$ (compared with the flowing channel within the output section), thereby preventing air-leaking through air inlets (210$c_2$, 210$c_3$). Therefore, the air inlet 210$c_1$ within the output section $C_1$ has an outmost edge, which is farther from the center 205 (distance $R_1$) than an outmost edge of the air inlet 210$c_2$ (with a distance $R_2$ from the center 205) within the pressure-enhanced section $A_1$ or an outmost edge of the air inlet 210$c_3$ (with a distance $R_3$ from the center 205) within the pressure-enhanced section $B_1$. Because the first pressure-enhanced section $A_1$ is relatively low pressure-enhanced than the second pressure-enhanced section $B_1$, the first pressure-enhanced section $A_1$ is equipped with a narrower width $D_1$ while the second pressure-enhanced section $B_1$ is equipped with a wider width $D_1$. That is, the outmost edge of the air inlet 210$c_2$ is farther from the center 205 (with a distance $R_2$ from the center 205) than the outmost edge of the air inlet 210$c_3$ (with a distance $R_3$ from the center 205).

Figure 5:
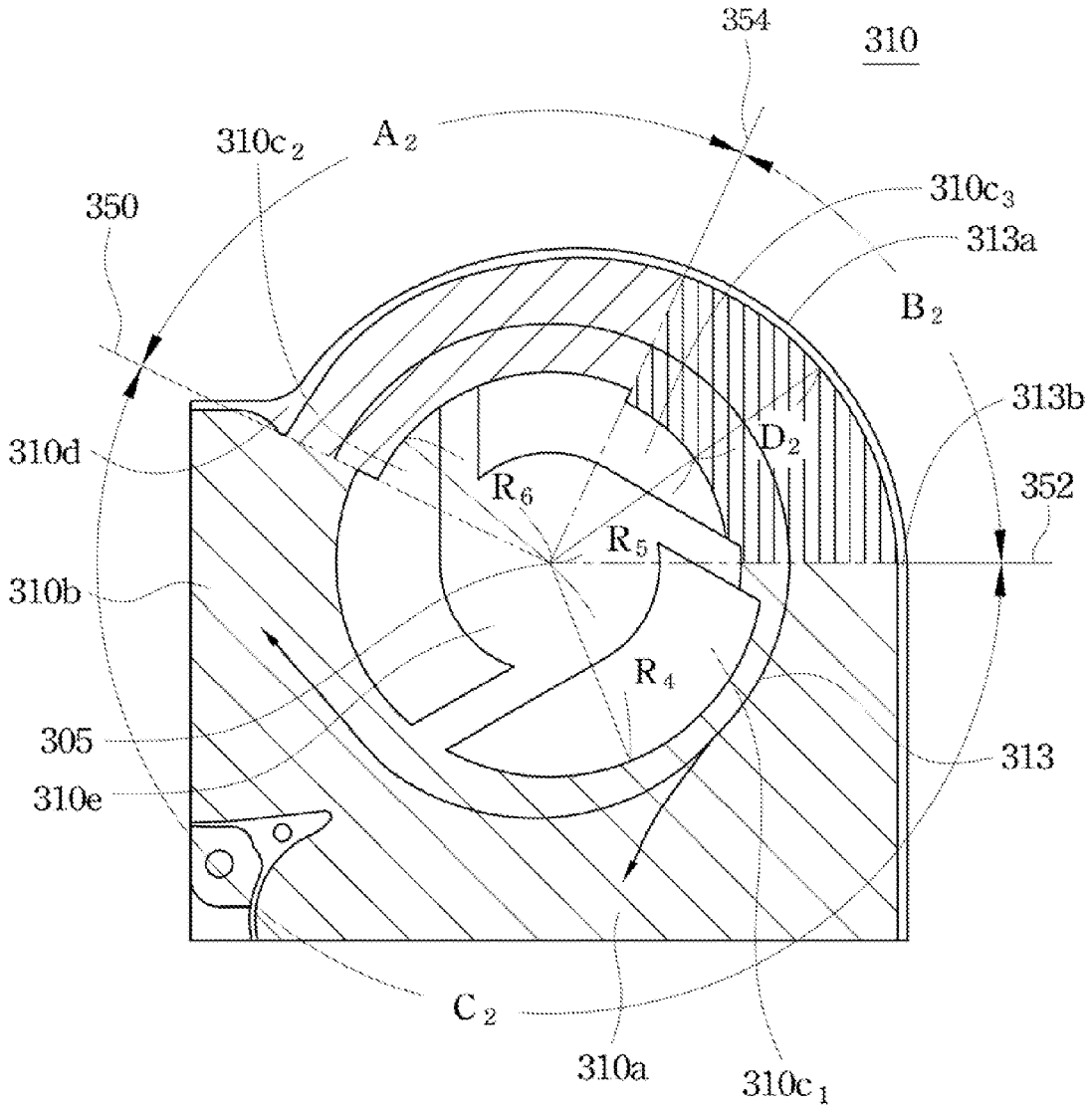
FIG. 5 illustrates a top view of a lower case of the centrifugal fan according to another preferred embodiment of this invention.

Referring to FIG. 5, illustrated is a top view of a lower case of the centrifugal fan according to another preferred embodiment of this invention. This embodiment is different from the embodiment of FIG. 4 in a number of the air outlets. In this embodiment, the lower case 310 is equipped with two radial air outlets (310*a*, 310*b*). The flowing channel 313 of the lower case 310 is divided into a pressure-enhanced sections ($A_2$+$B_2$) and an output section $C_2$. The airflows are gradually increased within the pressure-enhanced section ($A_2$+$B_2$) and then output through the output section $C_2$. Basically, an area of the flowing channel 313, which is close to the air outlet, is referred as the "output section". The pressure-enhanced section of the flowing channel 313 starts from a tongue portion 310*d* and ends at the output section. The pressure-enhanced section can be further divided into a first pressure-enhanced section $A_2$ (with a lower pressure enhanced) and second pressure-enhanced section $B_2$ (with a high pressure enhanced), but a boundary line 354 therebetween is hard to draw. Generally, the first pressure-enhanced section $A_1$ is a region of 30-90 degrees starting from the tongue portion 310*d*. In this embodiment, a boundary line 350 between the first pressure-enhanced section $A_2$ and the output section $C_2$ is a line interconnected between the tongue portion 310*d* and a center 305 of the bottom base 310*e*. A boundary line 352 between the second pressure-enhanced section $B_2$ and the output section $C_2$ is a line interconnected between the center 305 and a terminal end 313*b* of the arc sidewall 313*a* of the flowing channel 313. The flowing channel within the pressure-enhanced section has a wider width $D_2$ (compared with the flowing channel within the output section), thereby preventing air-leaking through air inlets (310$c_2$, 310$c_3$). Therefore, the air inlet 310$c_1$ within the output section $C_2$ has an outmost edge, which is farther from the center 305 (distance $R_4$) than an outmost edge of the air inlet 310$c_2$ (with a distance $R_6$ from the center 305) within the pressure-enhanced section $A_2$ or an outmost edge of the air inlet 310$c_3$ (with a distance $R_5$ from the center 305) within the pressure-enhanced section $B_2$. Because the first pressure-enhanced section $A_2$ is relatively low pressure-enhanced than the second pressure-enhanced section $B_2$, the first pressure-enhanced section $A_2$ is equipped with a narrower width $D_2$ while the second pressure-enhanced section $B_2$ is equipped with a wider width $D_2$. That is, the outmost edge of the air inlet 310$c_2$ is farther from the center 305 (with a distance $R_6$ from the center 305) than the outmost edge of the air inlet 310$c_3$ (with a distance $R_5$ from the center 305).

Figure 6:
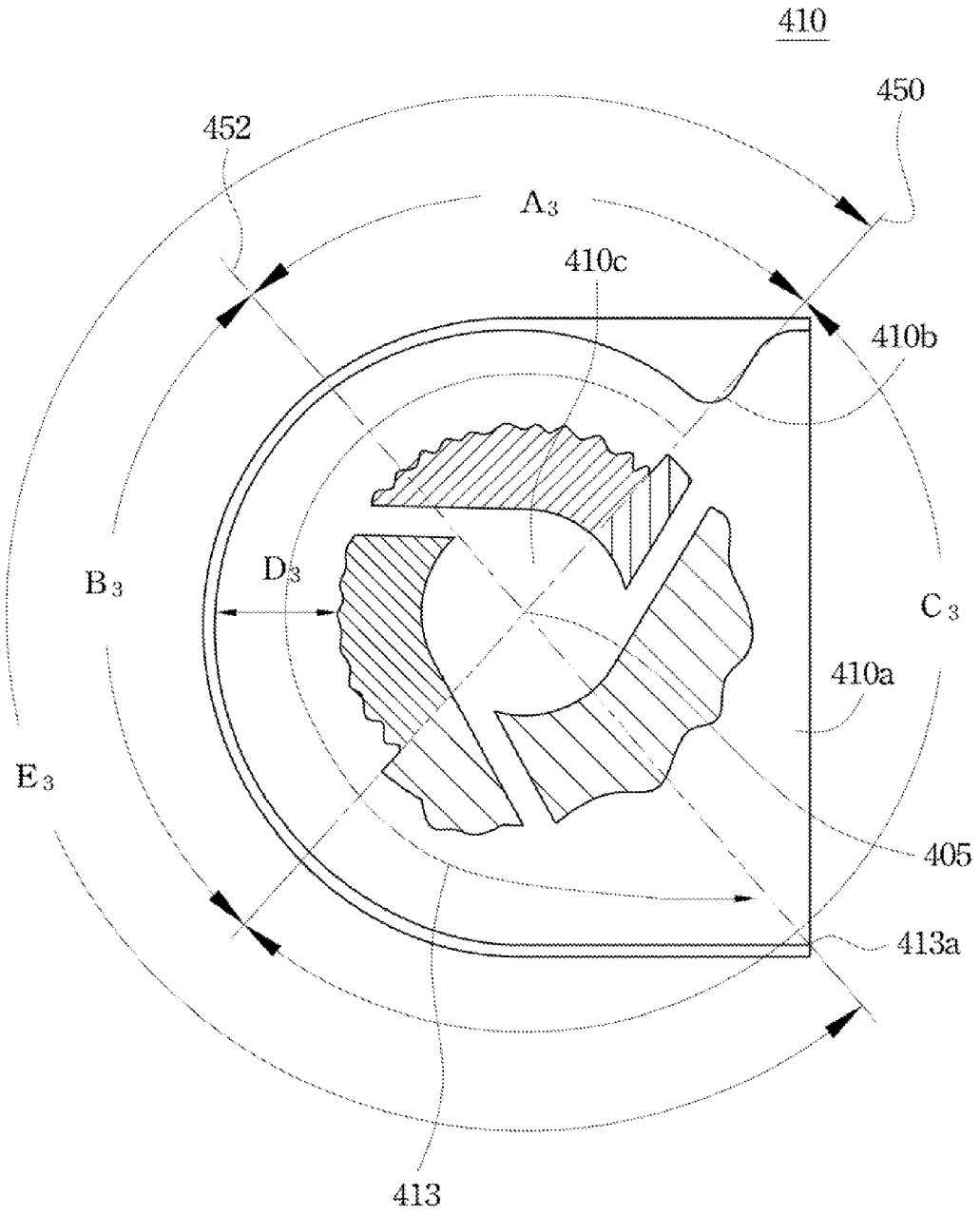
FIG. 6 illustrates a top view of a lower case of the centrifugal fan according to still another preferred embodiment of this invention.

Referring to FIG. 6, illustrated is top view of a lower case of the centrifugal fan according to still another preferred embodiment of this invention. This embodiment is different from the above-discussed embodiments in that the air inlet has an irregular shape. In this embodiment, the air inlet's arc edge is irregular and not smooth. The flowing channel 413 of the lower case 410 is divided into a pressure-enhanced section ($A_3$+$B_3$) and an output section $C_3$. The airflows are gradually increased within the pressure-enhanced section ($A_3$+$B_3$) and then output through the output section $C_3$. Basically, an area of the flowing channel 413, which is close to the air outlet, is referred as the "output section". The pressure-enhanced section of the flowing channel 413 starts from a tongue portion 410*b* and ends at the output section. The pressure-enhanced section can be further divided into a first pressure-enhanced section $A_3$ (with a lower pressure enhanced) and second pressure-enhanced section $B_3$ (with a high pressure enhanced), but a boundary line therebetween is hard to draw. In this embodiment, the first pressure-enhanced section $A_3$ and second pressure-enhanced section $B_3$ can be ⅓ of an angle region $E_3$, respectively. In this embodiment, a boundary line 450 between the pressure-enhanced section ($A_3$+$B_3$) and the output section $C_3$ is a line interconnected between the tongue portion 410*b* and a center 405 of the bottom base 410*c*. The first pressure-enhanced section $A_3$ and second pressure-enhanced section $B_3$ are of equal angles and divided by a boundary line 452. The flowing channel within the pressure-enhanced section has a wider width $D_3$ (compared with the flowing channel within the output section), thereby preventing air-leaking through air inlets. In this embodiment, when the air inlet within the output section $C_3$ has an area, which is 2.2 times bigger than an area of the air inlet within the first pressure-enhanced section $A_3$, air-leaking though the air inlets and air-leaking noises can be effectively reduced. Because the first pressure-enhanced section $A_3$ is relatively low pressure-enhanced than the second pressure-enhanced section $B_3$, the first pressure-enhanced section $A_3$ is equipped with a narrower width $D_3$ while the second pressure-enhanced section $B_3$ is equipped with a wider width $D_3$. When the air inlet within the second pressure-enhanced section $B_3$ has an area, which is smaller than a 9/10 area of the air inlet within the first pressure-enhanced section $A_3$, air-leaking though the air inlets and air-leaking noises can be effectively reduced.

Figure 7:
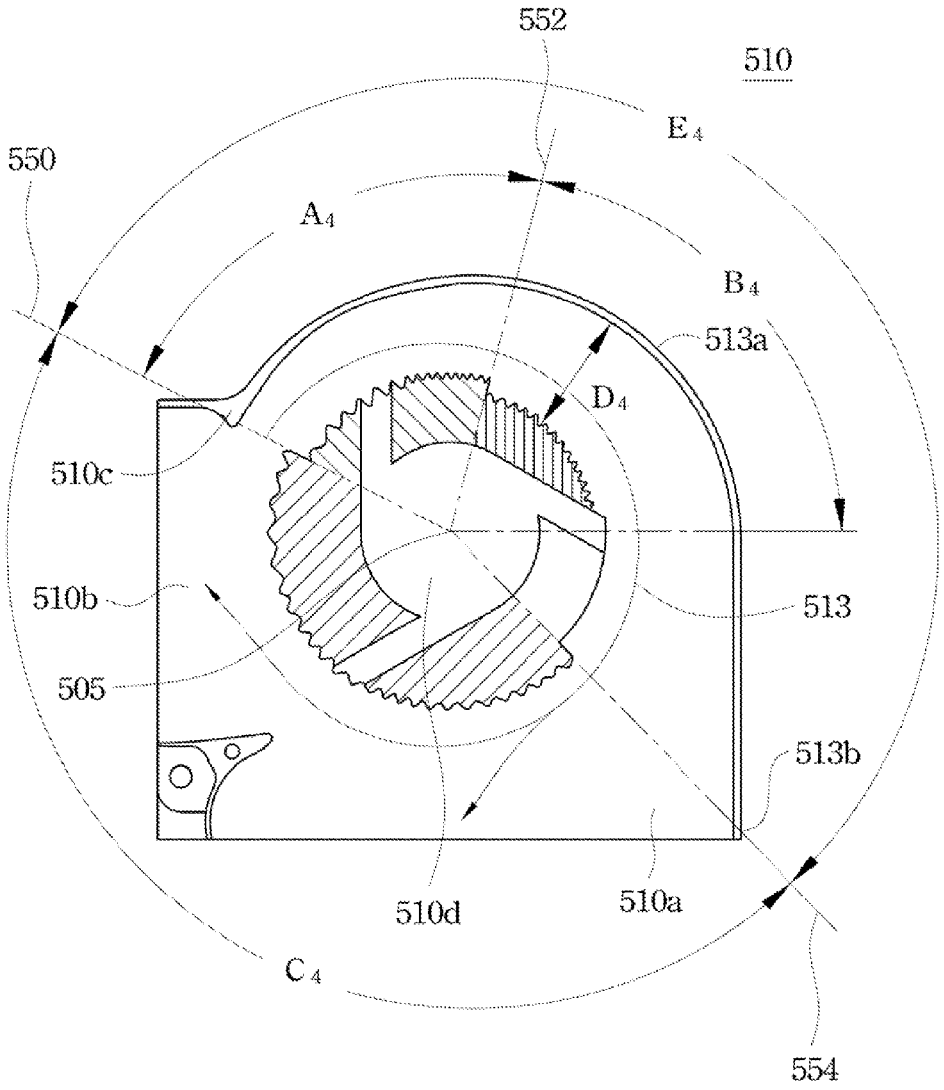
FIG. 7 illustrates a top view of a lower case of the centrifugal fan according to still another preferred embodiment of this invention.

Referring to FIG. 7, illustrated is top view of a lower case of the centrifugal fan to according to still another preferred embodiment of this invention. This embodiment is different from the embodiment of FIG. 6 in a number of the air outlets. In this embodiment, the lower case 510 is equipped with two radial air outlets (510*a*, 510*b*). The flowing channel 513 of the lower case 510 is divided into a pressure-enhanced sections ($A_4$+$B_4$) and an output section $C_4$. The airflows are gradually increased within the pressure-enhanced section ($A_4$+$B_4$) and then output through the output section $C_4$. Basically, an area of the flowing channel 513, which is close to the air outlet, is referred as the "output section". The pressure-enhanced section can be further divided into a first pressure-enhanced section $A_4$ (with a lower pressure enhanced) and second pressure-enhanced section $B_4$ (with a high pressure enhanced), but a boundary line therebetween is hard to draw. In this embodiment, the first pressure-enhanced section $A_4$ and second pressure-enhanced section $B_4$ can be ⅓ of an angle region $E_4$, respectively. In this embodiment, a boundary line 550 between the first pressure-enhanced section $A_4$ and the output section $C_4$ is a line interconnected between a tongue portion 510*c* and a center 505 of the bottom base 510*d*. The first pressure-enhanced section $A_4$ and second pressure-enhanced section $B_4$ are of equal angles and divided by a boundary line 552. A boundary line 554 between the angle region $E_4$ and the output section $C_4$ is a line interconnected between the center 505 and a terminal end 513*b* of the arc sidewall 513*a*. The flowing channel within the pressure-enhanced section has a wider width $D_4$ (compared with the flowing channel within the output section), thereby preventing air-leaking through air inlets. In this embodiment, when the air inlet within the output section $C_4$ has an area, which is 2.2 times bigger than an area of the air inlet within the first pressure-enhanced section $A_4$, air-leaking though the air inlets and air-leaking noises can be effectively reduced. Because the first pressure-enhanced section $A_4$ is relatively low pressure-enhanced than to the second pressure-enhanced section $B_4$, the first pressure-enhanced section $A_4$ is equipped with a narrower width $D_4$ while the second pressure-enhanced section $B_4$ is equipped with a Wider width $D_4$. When the air inlet within the second pressure-enhanced section $B_4$ has an area, which is smaller than a 9/10 area of the air inlet within the first pressure-enhanced section $A_4$, air-leaking though the air inlets and air-leaking noises can be effectively reduced.

Figure 8:
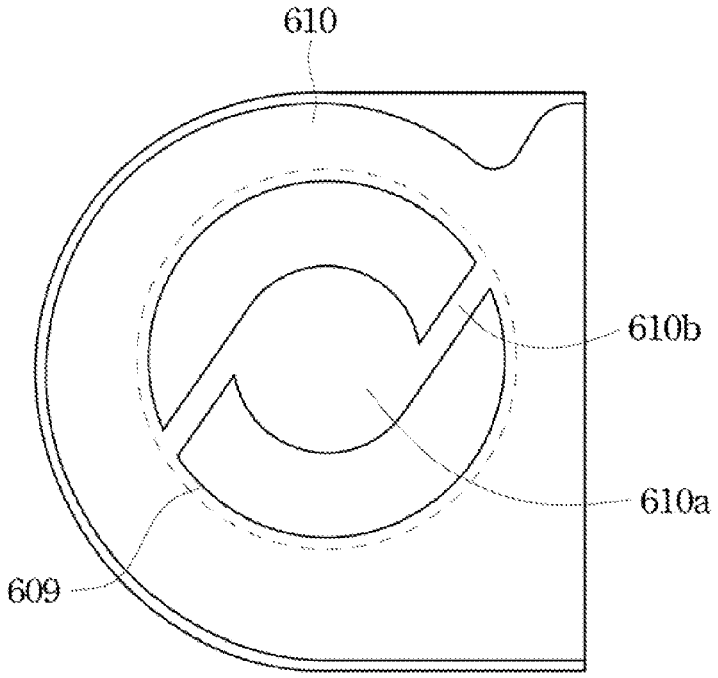
FIG. 8 illustrates a top view of a lower case of the centrifugal fan according to still another preferred embodiment of this invention.
Figure 9:
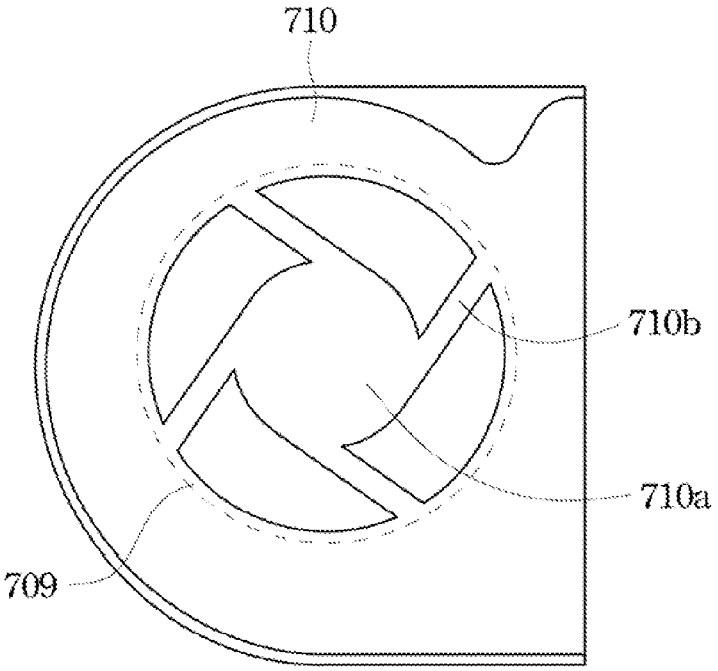
FIG. 9 illustrates a top view of a lower case of the centrifugal fan according to still another preferred embodiment of this invention.

The above-discussed embodiments can also be applied in the lower cases (610, 710) as illustrated in FIGS. 8 and 9, or other lower cases with multiple ribs, e.g. more than four ribs. An axial inlet section 609 of the lower case 610 has two ribs 610*b*, which are interconnected between the bottom base 610*a* and the lower case 610, so as to define air inlets among the ribs 610*b*. An axial inlet section 709 of the lower case 710 has four ribs 710*b*, which are interconnected between the bottom base 710*a* and the lower case 710, so as to define air inlets among the ribs 710*b*.

According to the above-discussed embodiments, the centrifugal fan with the improved axial inlet section design can be enhanced in reducing air-leaking though the air inlets and air-leaking noises.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A centrifugal fan comprising:

an impeller;

a driving device, connected to the impeller and driving the impeller to rotate; and a case, housing the impeller and the driving device so as to form a flowing channel therein, the flowing channel comprising a pressure-enhanced section and an output section, the case comprising an axial inlet section and at least a radial air outlet, the axial inlet section comprises:

a bottom base, securing the driving device and having a center; and a plurality of ribs interconnected between the bottom base and the case, thereby defining a plurality of air inlets among the ribs, the bottom base and the case, wherein the output section has a first air inlet, the pressure-enhanced section has a second air inlet, the first air inlet within the output section has a first outmost edge, which is farther from the center than remaining edges of the first air inlet, the second air inlet within the pressure-enhanced section has a second outmost edge, which is farther from the center than the center than remaining edges of the second air inlet, the first outmost edge is farther from the center than the second outmost edge.

2. The centrifugal fan of claim 1, wherein an arc sidewall of the flowing channel has a tongue portion close to the air radial air outlet.

3. The centrifugal fan of claim 2, wherein a first boundary line between the output section and the pressure-enhanced section is a line interconnected between the tongue portion and the center.

4. The centrifugal fan of claim 3, wherein a second boundary line between the output section and the pressure-enhanced section is a line interconnected between a terminal end of the arc sidewall and the center.

5. A centrifugal fan comprising:

an impeller;

a driving device, connected to the impeller and driving the impeller to rotate;

a bottom base, securing the driving device and having a center; and a case housing the impeller and the driving device so as to form a flowing channel therein, the flowing channel comprising a pressure-enhanced section and an output section, the case comprising an air input section, an axial inlet section and at least a radial air outlet, wherein an arc sidewall of the flowing channel has a tongue portion close to the radial air outlet, a boundary line interconnected between the the tongue portion and the center, and a straight extension line of the boundary line collectively divided the flowing channel into the output section and the pressure-enhanced section, the axial inlet section comprises:

a plurality of ribs interconnected between the bottom base and the case, thereby defining a plurality of air inlets among the ribs, the bottom base and the case, wherein the output section has first air inlets, the pressure-enhanced section has second air inlets, an area of all the first air inlets is larger than an area of all the second air inlets.

6. The centrifugal fan of claim 5, wherein the pressure-enhanced section is equally divided into a first pressure-enhanced section and a second pressure-enhanced section of equal angles, wherein the first pressure-enhanced section is closer to the tongue portion than the second pressure-enhanced section is.

7. The centrifugal fan of claim 6, wherein an area of all the first air inlets is 2.2 times bigger than an area of the second air inlets within the first pressure-enhanced section.

8. The centrifugal fan of claim 6, wherein an area of the second air inlets within the second pressure-enhanced section is smaller than a 9/10 area of the second air inlets within the first pressure-enhanced section.

* * * * *